US006868989B2

(12) United States Patent
Fahy et al.

(10) Patent No.: US 6,868,989 B2
(45) Date of Patent: Mar. 22, 2005

(54) CLEANER WITH ADJUSTABLE AEROSOL CANISTER RETAINER

(75) Inventors: Cathal L. Fahy, Columbus, OH (US); Dale Aberegg, Mt. Vernon, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/386,009

(22) Filed: Mar. 10, 2003

(65) Prior Publication Data

US 2004/0178224 A1 Sep. 16, 2004

(51) Int. Cl.[7] ..... B05B 12/00
(52) U.S. Cl. ..... 222/174; 222/325; 248/312.1
(58) Field of Search ..... 222/174, 325; 248/312.1

(56) References Cited

U.S. PATENT DOCUMENTS

| | | | | |
|---|---|---|---|---|
| 2,400,084 A | | 5/1946 | Fouke | |
| 2,720,422 A | * | 10/1955 | Mercur | 222/174 |
| 2,953,283 A | * | 9/1960 | Palkowski | 222/174 |
| 2,990,979 A | | 7/1961 | Harrison et al. | |
| 3,032,081 A | * | 5/1962 | La Cotta | 141/362 |
| 3,039,657 A | * | 6/1962 | Meuwly | 222/174 |
| 3,123,851 A | | 3/1964 | Arndt et al. | |
| 3,148,403 A | | 9/1964 | Hershberger et al. | |
| 3,220,613 A | * | 11/1965 | Palmer et al. | 222/174 |
| 3,269,601 A | * | 8/1966 | Weber, III | 222/647 |
| 3,659,791 A | * | 5/1972 | Clark | 239/375 |
| 3,679,319 A | | 7/1972 | Munchel et al. | |
| 3,794,217 A | | 2/1974 | Munchel | |
| 3,977,570 A | * | 8/1976 | Smrt | 222/174 |
| 4,538,745 A | | 9/1985 | Dunning et al. | |
| 4,781,311 A | | 11/1988 | Dunning et al. | |
| 4,789,084 A | * | 12/1988 | Yoshitomi | 222/174 |
| 4,886,191 A | | 12/1989 | Yoshitomi | |
| D333,095 S | * | 2/1993 | Haubner | D9/434 |
| 5,518,148 A | * | 5/1996 | Smrt | 222/174 |
| 5,767,055 A | | 6/1998 | Choy et al. | |
| 5,779,155 A | | 7/1998 | Schennum et al. | |
| 5,888,006 A | | 3/1999 | Ping et al. | |
| 5,948,741 A | | 9/1999 | Ochomogo et al. | |
| 5,948,742 A | | 9/1999 | Chang et al. | |
| 6,048,123 A | | 4/2000 | Holt et al. | |
| 6,146,041 A | | 11/2000 | Chen et al. | |
| 6,217,244 B1 | | 4/2001 | Chen et al. | |
| 6,318,600 B1 | * | 11/2001 | Winnett et al. | 222/174 |
| 6,497,525 B1 | | 12/2002 | Huang | |
| 2001/0046407 A1 | | 11/2001 | Kunkler et al. | |
| 2002/0168216 A1 | | 11/2002 | Policicchio et al. | |

FOREIGN PATENT DOCUMENTS

| | | |
|---|---|---|
| DE | 3940123 | 6/1990 |
| FR | 2760658 | 9/1998 |
| JP | 2001145450 | 5/2001 |

OTHER PUBLICATIONS

A two–page website excerpt entitled "Grab–it Go Mop Instructions", dated Mar. 26, 2003.

* cited by examiner

*Primary Examiner*—Kenneth Bomberg

(57) ABSTRACT

A trigger actuated cleaning device includes an adjustable retainer assembly for alternately holding a full-size or compact aerosol spay canister, thereby allowing the device to be used as a mop with an extension wand and a large canister or a wandless hand-held device with a small canister. The retainer has a "ski-boot" configuration with a heel assembly slidable on a fixed rail having a spring biased latch engaging the rim at the bottom of the canister and clamping it against a toe stop, which is configured to align the canister with a trigger operated actuator. The heel assembly slides and locks in position for either a full-size or compact canister to snap into the device. The canister is removed by depressing a thumb operated release lever which clears the latch from the canister.

13 Claims, 8 Drawing Sheets

CLEANER WITH ADJUSTABLE AEROSOL CANISTER RETAINER

CROSS-REFERENCE TO RELATED APPLICATIONS

Not applicable.

STATEMENT OF FEDERALLY SPONSORED RESEARCH OR DEVELOPMENT

Not applicable.

FIELD OF THE INVENTION

The present invention relates to cleaning devices and in particular to cleaning devices using aerosol spray cans for dispensing a cleaning agent to assist in cleaning surfaces.

BACKGROUND OF THE INVENTION

Cleaning products have been developed that dispense a cleaning agent onto the surface being cleaned near the cleaning head of the device. Some such devices dispense gravity fed liquid cleansers and some dispense the cleaner in the form of an aerosol spray. The latter type of these cleaning devices have an aerosol canister (with the cleaning chemical and the propellant) mounted to the device typically between the cleaning head and a handle. The canister can be mounted to a pole to assist in reaching high ceilings or underneath furniture, to reduce straining one's arms, neck and back. Some of these devices also are actuated remotely by a trigger, which keeps the chemical from contacting the skin of the user and also assists in consistent spraying. See e.g. U.S. Pat. Nos. 3,679,319, 3,794,217, 4,789,084, 4,886,191 and 5,779,155. The disclosures of these patents are hereby incorporated by reference as if fully set forth herein.

Conventional aerosol spraying cleaning devices are usually designed to work with one size of aerosol canister. Increasingly, however, cleansers are sold in various sized canisters. Thus, for one application, cleaning windows for example, the window cleaning agent may be in a canister of a size too large or small to fit into the cleaning device. In this regard, it may be desirable to use smaller canisters for hand-held devices in which the canister is held off the ground or overhead by the user (again as when cleaning windows) to reduce the weight of the device and thereby strain on the user's arm.

A device with an adjustable canister mounting assembly has been developed. For example, U.S. Pat. No. 4,886,191 discloses a trigger operated device having a pole on which can slide a holder that presses against the bottom cupped end of the canister to clamp it in place. The holder is free to slide along the pole and thus accommodate different sized canisters before it is locked in place. This patent also discloses a simple bolt arrangement that can be threaded at different lengths against the bottom of the canister.

Both of the disclosed techniques use somewhat unsophisticated mechanisms that require significant manipulation to mount the canister to the device. The same is true to remove the canister, which requires the back end holder to be moved, for example by numerous rotations of the bolt, back from the canister sufficiently to allow the cupped back end of the canister to clear the holder. Moreover, the disclosed devices make no provision to assist in rapid adjustment for common canister sizes. Nor do these devices provide away to select which size canisters can be securely retained, which may be desired to ensure that the proper chemical is being dispensed by the device.

Thus, a need exists for a cleaning device with a better solution for mounting the aerosol canister.

SUMMARY OF THE INVENTION

One aspect of the invention provides an adjustable canister retainer for alternately holding a full-size or compact aerosol spray canister. In another aspect the invention provides a trigger actuated cleaning device having such a canister retainer convertible from a mop-type configuration with an extension wand and a wandless hand-held device. Preferably, a full-size aerosol canister is used with the former and a compact canister is used with the latter.

In particular, the present invention provides an adjustable retainer for mounting a canister containing a pressurized cleaning agent to a cleaning device. The retainer has a fixed toe stop and rail and a heel assembly slidably mounted to the rail. The heel assembly is adapted to be releasably held in a fixed position with respect to the rail and includes a latch to releasably lock the canister between the heel assembly and the toe stop.

In a preferred form, the heel assembly includes a slide having a track slidably engaging the rail to retain it to the rail. A lock arrangement releasably fixes the position of the slide in one of two preset positions to space the heel assembly from the toe stop to mount either a full-size or a compact aerosol canister. Preferably, the lock arrangement includes a deflectable tab attached to either the slide or the rail and two tab receivers or openings spaced apart along the other of the mating components. Depressing the tab out of the receiver allows the slide to be slid along the rail to adjust the spacing between the heel and toe to hold the desired canister size.

In another preferred form, the toe stop is disposed at one end of the rail in contact with one end of the canister having a special actuator overcap. The toe stop includes an alignment feature mating with a corresponding recess in the overcap to orient the canister with respect to a trigger operated actuator member movable to open a valve of the canister to spray out cleaner.

In still another form, the latch of the heel assembly is spring biased so the canister can simply snap into the retainer. The latch thus automatically catches the rim at the bottom of the canister. The heel assembly has a thumb operated pivotal release lever engaging the latch in a bayonet type connection to pivot against the spring away from the toe stop. A latch mount at one end of the slide defines two pivot grooves, on each side of an upstanding wall, receiving pivot ends of the latch and release lever. Depressing the release lever thus pulls the latch out of abutment with a canister and allows it to be simply pulled from the device.

In another aspect the invention provides a trigger actuated cleaning device having a cleaning head and a grip assembly mounted to a retainer assembly as described above. The cleaning head can be permanently or detachably mounted to the retainer assembly and can be of any suitable type of cleaning surface, such as a cloth sheet, a sponge or scrubber pad, a bristle brush, or a scraping/wiping blade. The grip assembly has a handle and a trigger that operates an actuator assembly causing the cleaning agent to be dispensed from the canister. Preferably, the grip and trigger are located as part of a body having the retainer assembly so that the device may be used as a hand-held device. The trigger is near the heel assembly such that the slide tends to block access to the trigger when in the extended position and is cleared from the trigger when in the retracted position. The device may be used as a mop by adding an extension wand (made up of one or more shaft segments) having a second grip assembly with its own trigger capable of operating the actuator assembly via additional actuating members within the wand.

Thus, the present invention provides a trigger actuated cleaning device that is convertible between pole and hand-held configurations. It further is adapted to retain an aerosol spray canister of cleaner in either of two sizes such that a smaller can be used when the device is used overhead or otherwise lifted, such as when in the hand-held configuration, to reduce arm strain on the user. Different canister sizes may also be advantageous for use with a variety of cleanser types that are used more or less frequently. The canisters snap into the device and release with the press of a button. A simple sliding adjustment accommodates a different sized canister. A deflectable locking tab stops and secures the sliding components at the desired locations for each preferred canister size.

These and other advantages of the invention will be apparent from the detailed description and drawings. It should be understood that the following is merely a preferred embodiment of the invention. The claims should be looked to in order to understand the full scope of the invention.

DETAILED DESCRIPTION OF THE PREFERRED EMBODIMENT

The present invention provides a trigger actuated cleaning device using an aerosol spray canister to dispense a cleaning agent. The primary focus of this application is an adjustable assembly for securing the canister to the cleaning device, and as such, this assembly will be described in detail. The other components of the cleaning device will be described generally here, however, a detailed description of similar components can be found in co-pending U.S. application Ser. No. 09/951,632, filed on Sep. 14, 2001 (now allowed), which is hereby incorporated by reference as though fully set forth herein.

Figure 1:
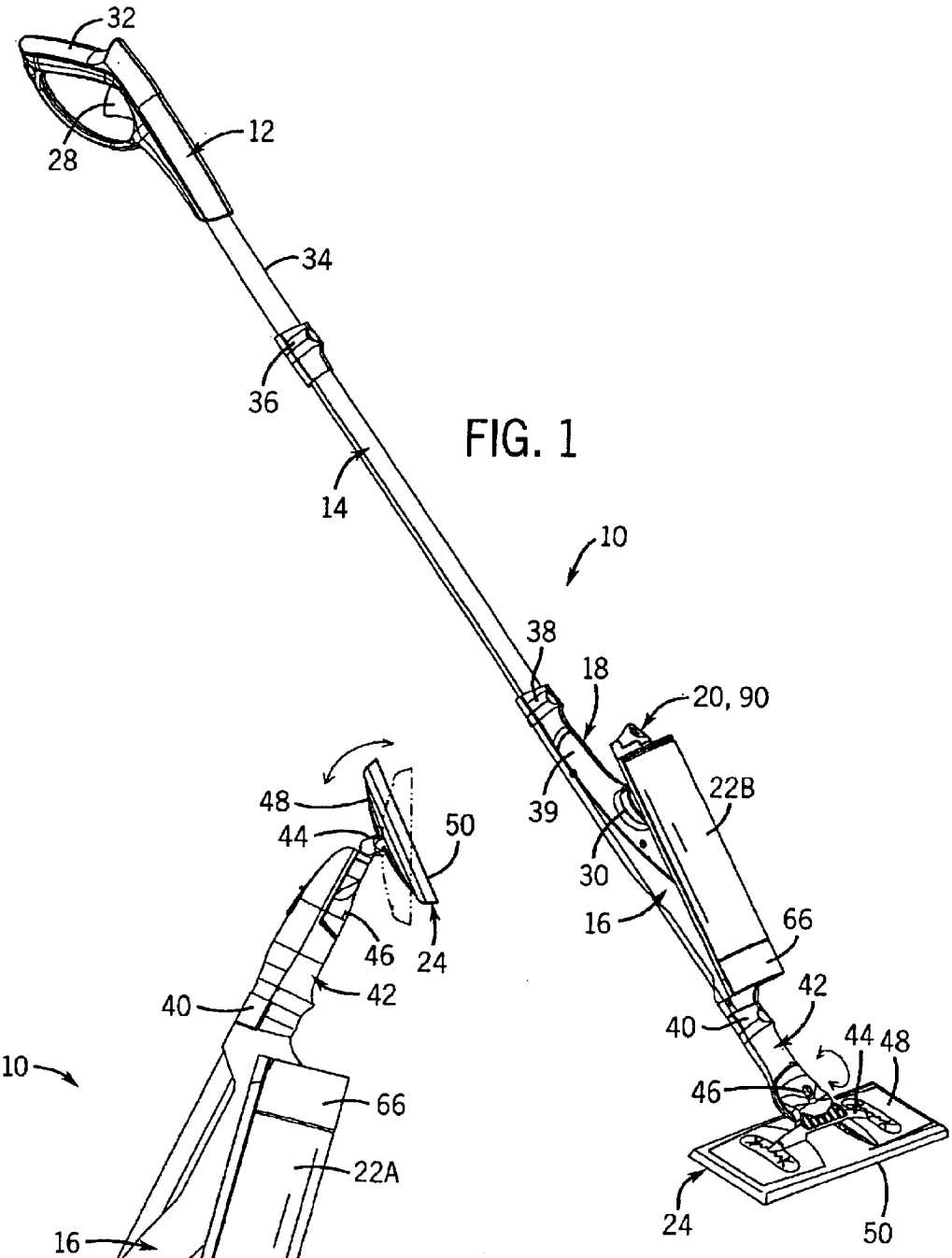
FIG. 1 is a perspective view of the cleaning device of the present invention shown assembled as a mop with an extension wand.
Figure 2:
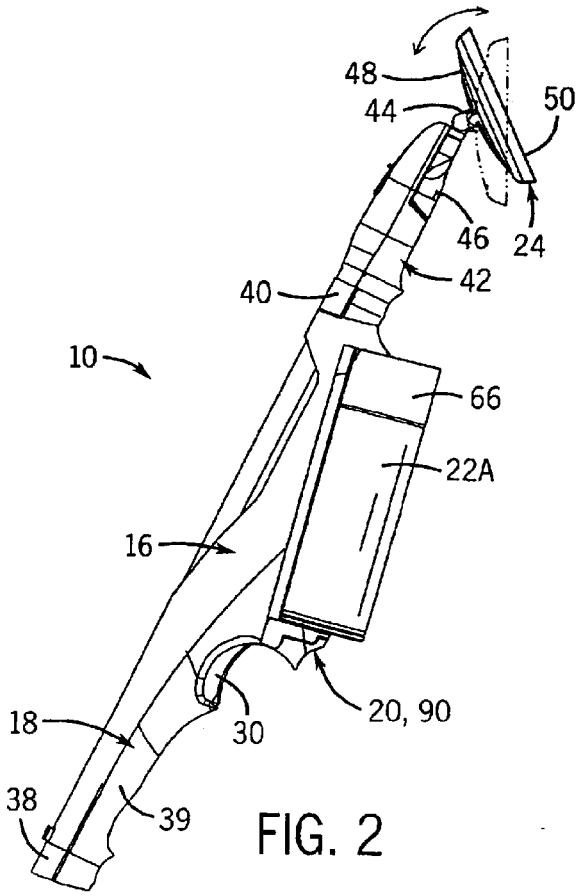
FIG. 2 is a side view of the cleaning device of FIG. 1 shown as a hand-held cleaner without the extension wand attached.

FIG. 1 of the drawings shows the cleaning device 10 of the present invention fully assembled in a mop-like configuration for cleaning floors or out of reach vertical or horizontal surfaces. FIG. 2 shows the cleaning device 10 with an extension wand removed so as to be shorter for cleaning nearby surfaces and to be more suitable for holding upright when cleaning close vertical surfaces, such as windows for example.

Figure 3:
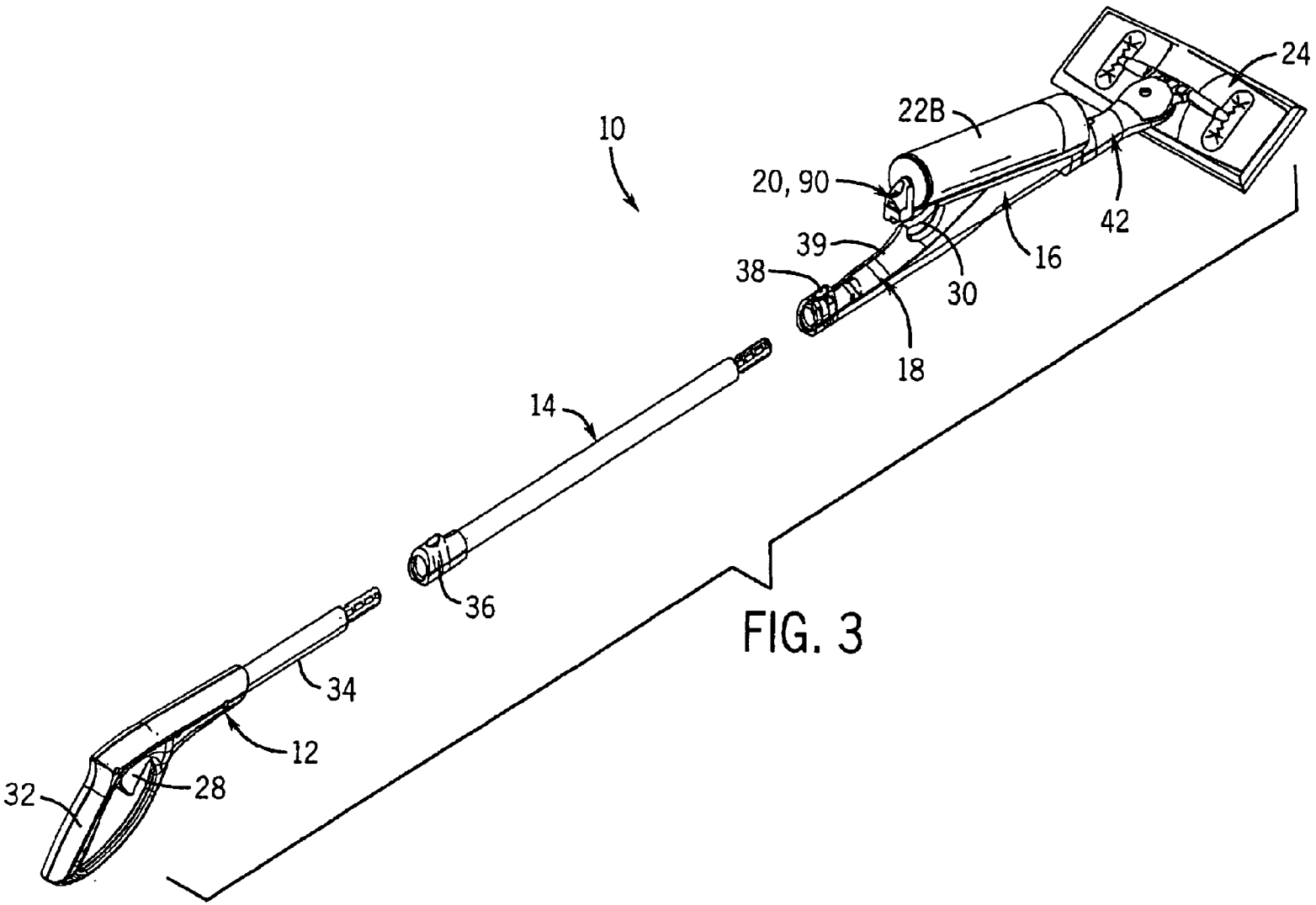
FIG. 3 is an exploded perspective view of the cleaning device.

With reference to these two figures and FIG. 3, the cleaning device 10 includes as major components a remote grip assembly 12, an extension wand 14, a main body 16 having its own grip assembly 18 and an adjustable retainer assembly 20 holding a canister 22 (either compact 22A or full-size 22B), and a cleaning head 24. Internal to many of these components is a movable actuator assembly 26, shown partially in FIGS. 6 and 7, linking triggers 28 and 30 of the two grip assemblies 12 and 18, respectively, to the canister 22 for spraying cleaner contained therein near the cleaning head 24.

The remote grip assembly 12 includes a hollow (two-piece) plastic pistol grip housing defining a handle 32 located near the pivotally mounted trigger 28 so it can be operated by an index finger when gripping the handle 32. A tubular shaft extension 34 plugs into a quick connect socket 36 at one end of the extension wand 14. Similarly, the opposite end of the extension wand 14 plugs into a quick connect socket 38 at the end of the main body 16. The sockets 38 contain button operated spring catches (as shown) for releasably retaining a plug end of the mating component. The ends of the shaft extension 34 and the extension wand 14 are identical as are the sockets 36 and 38, thus if desired, the extension wand 14 can be removed from the assembly so that the remote grip assembly 12 can by directly connected to the main body 16. As mentioned above and shown in FIG. 2, the remote grip assembly 12 and the extension wand 14 can be detached and the device held by a handle 39 to operate the device 10 using trigger 30.

The opposite end of the main body 16 fits into a socket 40 of a quick connect universal joint 42 coupled to the cleaning head 24. Any suitable construction can be used, but in one preferred form the quick connect universal joint 42 includes a pivot 44 assembly allowing the main body 16 (and components attached thereto) to pivot about an axis parallel to the width of the cleaning head 24. The universal joint 42 also includes a swivel 46 allowing rotation of the main body 16 in a plane extending through the pivot axis and about an axis perpendicular to that plane.

Part of the pivot assembly 44 is integral with a backing plate 48 of the cleaning head 24 supporting a compressible pad 50. The pad 50 can be a substrate for mounting a cleaning cloth or dusting sheet or it may be a sponge or scrubber pad. The plate 48 and pad 50 could of course be replaced by a bristled brush head, wiper blade or any other suitable cleaning implement desired.

The grip assembly 12, the extension wand 14 and the main body 16 housing have core pieces 52 (see FIG. 6) of the actuator assembly 26 that slide in response to movement of either or both of the triggers 28 and 30. More specifically, when trigger 28 is depressed it slides the inner core pieces in the remote grip assembly 12 downwardly which abut core pieces in the extension wand 14 and main body 16, which will contact a trip leg 54 of trigger 30 in turn abutting another core piece in the main body 16. This in turn pivots an actuator lever 56, a working end 58 of which moves components of the canister valve 60.

Figures 6, 8:
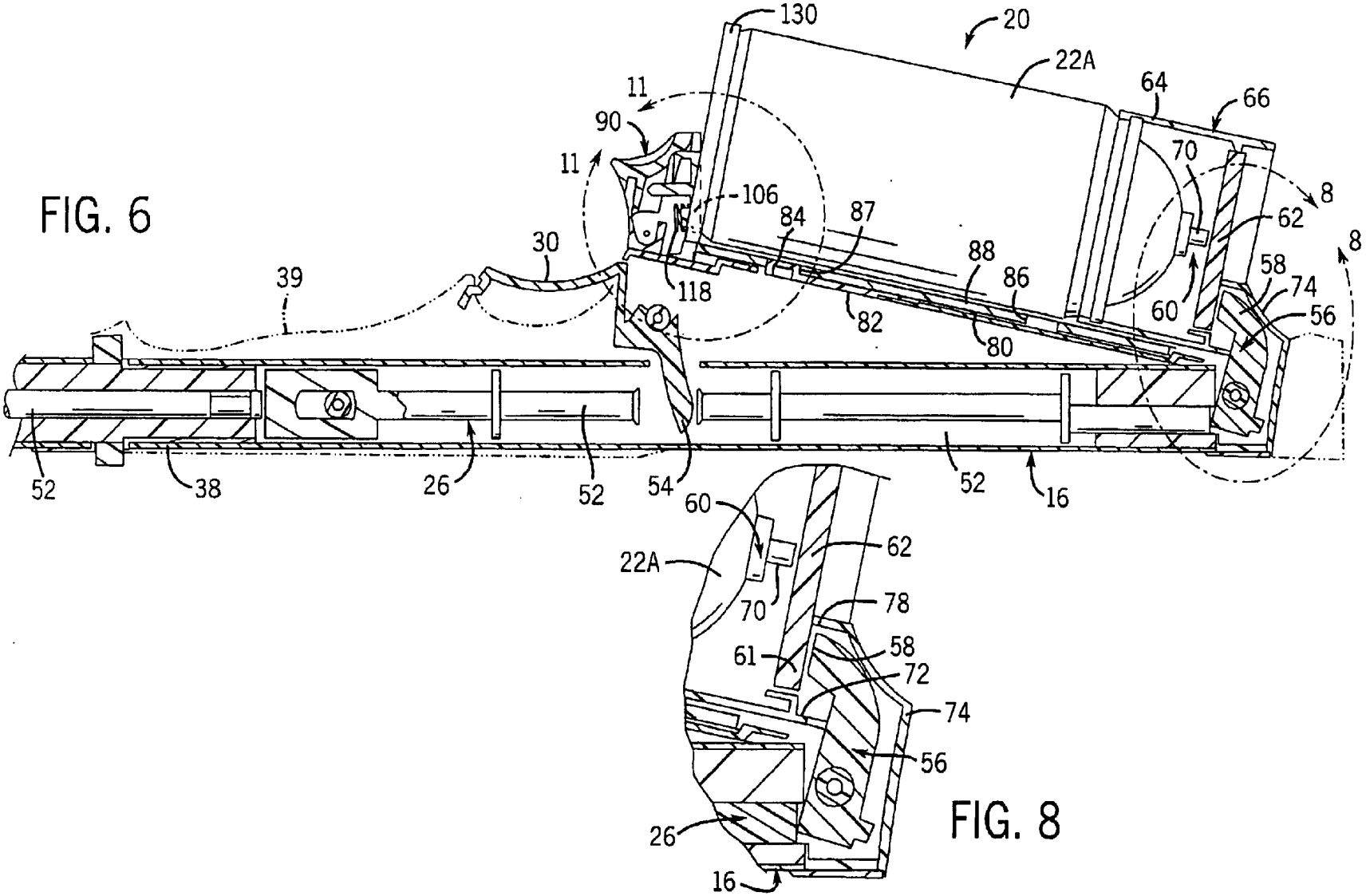
FIG. 6 is a partial cross-sectional view taken along line 6—6 of FIG. 4 showing the canister retainer in the retracted position to hold a compact canister.
FIG. 8 is a partial cross-sectional view taken along arc 8—8 of FIG. 6 showing a part of an actuation assembly at a toe of the adjustable canister retainer.

In particular, with reference to FIGS. 6 and 8, the actuator lever 56 contacts (when either trigger 28 or 30 is depressed) a free end 61 of a lever arm 62 hinged at the opposite end to a cylindrical wall 64 of an overcap 66 mounted to the valve end of the canister 22. The lever arm 62 moves a hollow valve stem 70 into abutment with the internal components of the canister valve 60 to dispense the cleaner. Although not shown, the lever arm 62 has a nozzle adapted to provide a fan-shaped spray at a predetermined angle as measured from the top of the overcap 66. This angle may be between 40° and 90°, preferably between 70° and 85°, and more preferably 78.5°.

Figure 4:
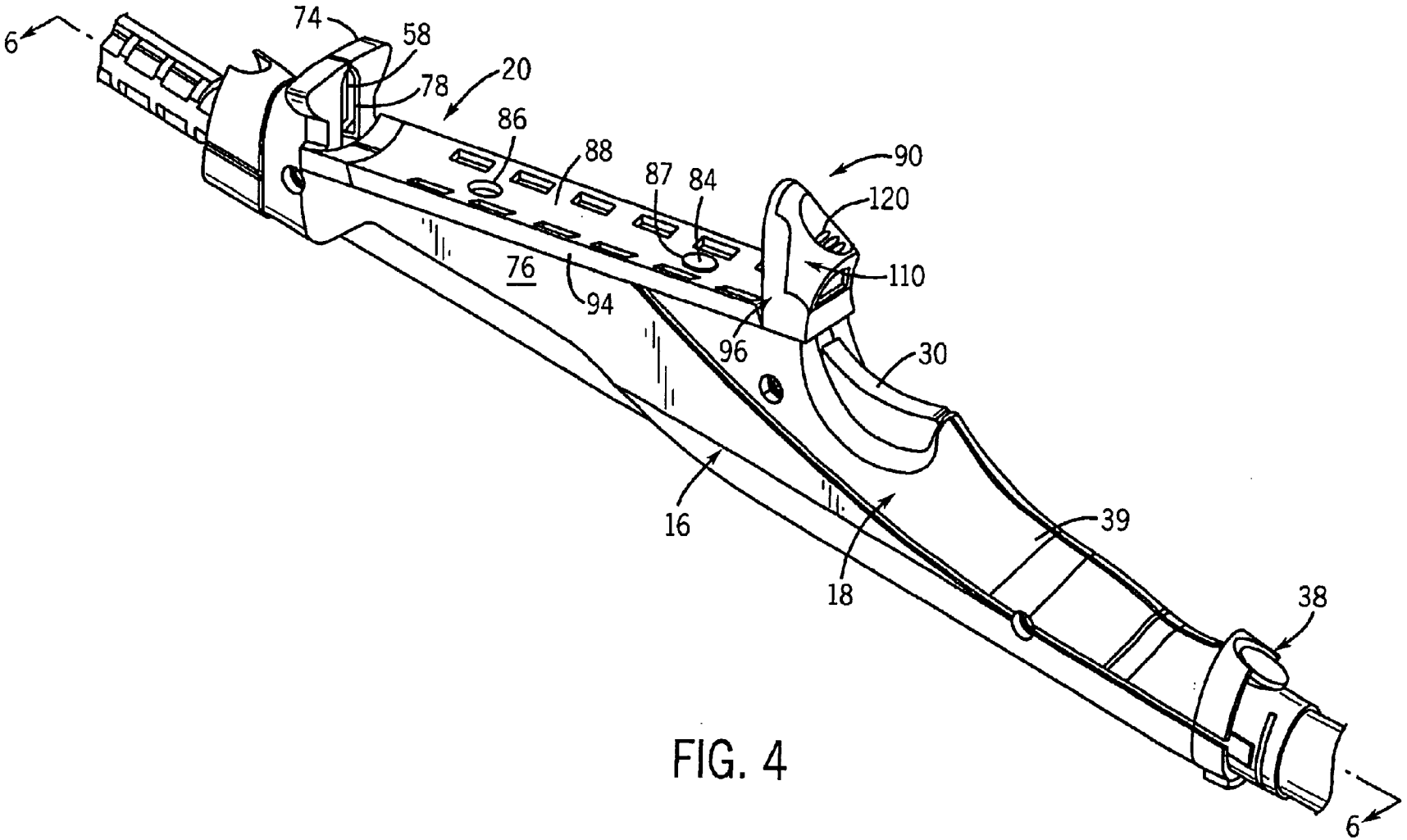
FIG. 4 is a partial perspective view of an adjustable canister retainer for the cleaning device shown in an retracted position for holding a compact aerosol canister.

Referring to FIGS. 4, 6 and 8, the overcap 66 also forms a generally D-shaped recess 72 with an open edge that, when inserted into the retainer assembly 20, receives a corresponding shaped toe stop 74 (see FIG. 4) extending up at essentially a right angle to an angled section 76 of the main body 16. This arrangement ensures that the canister 22 is properly oriented in the main body 16 so that the spray will be directed to the proper location near the cleaning head 24. The toe stop 74 has an opening 78 for end 58 of the actuator lever 56 to protrude when the triggers 28 and 30 are depressed. A rail 80 formed as a unitary part of the angled section 76 of the main body 16 extends from the toe stop 74 and preferably has a T-shaped cross-section. A locking tab 82 is formed in the rail 80 so that it is connected thereto at only one side allowing it to deflect. The locking tab 82 has a circular boss 84 sized to fit into two receivers 86 and 87 through an elongated slide 88 of a movable heel assembly 90.

Figure 5:
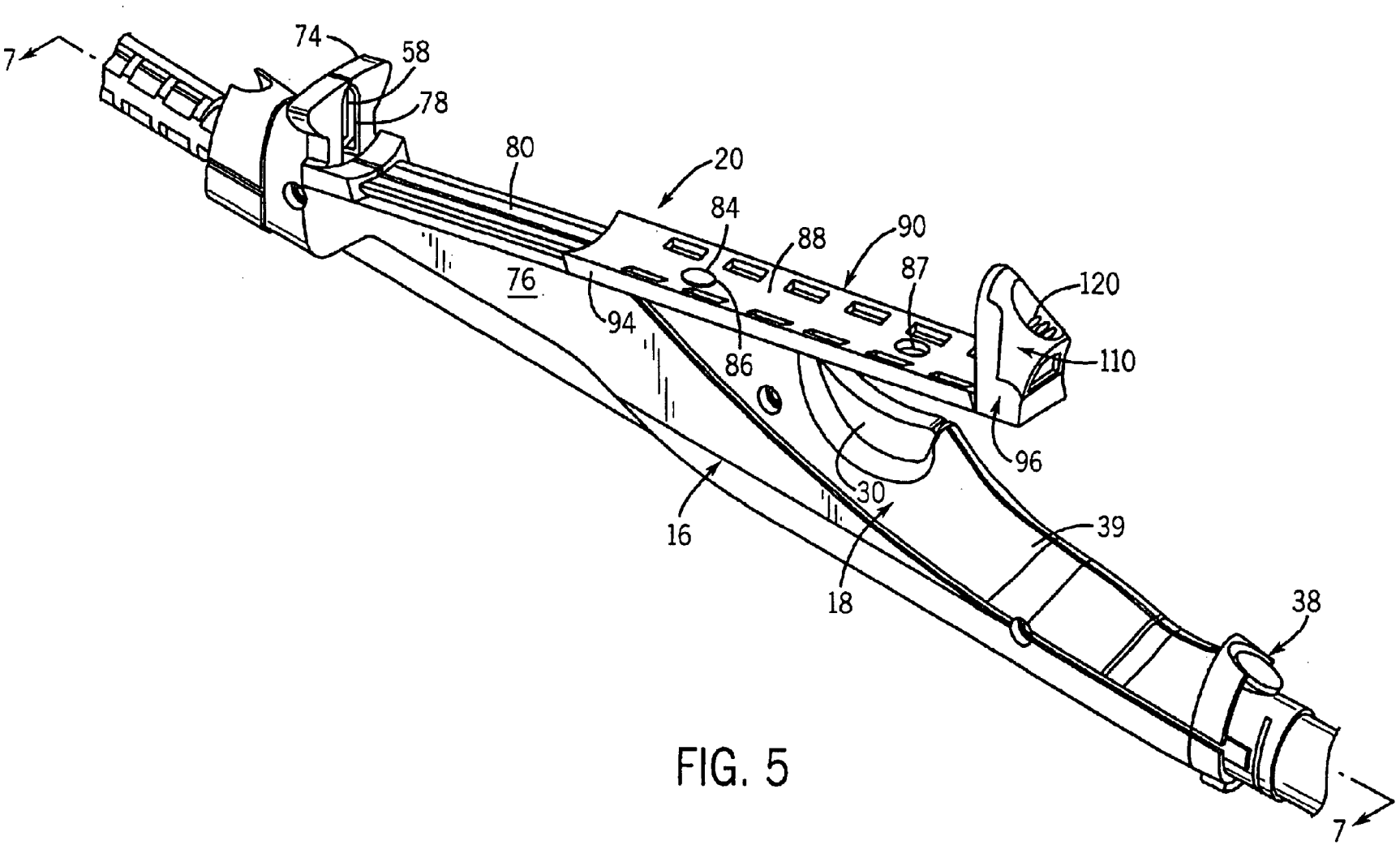
FIG. 5 is a view similar to FIG. 4 showing the canister retainer in an extended position for holding a conventional full-size aerosol canister.
Figure 7:
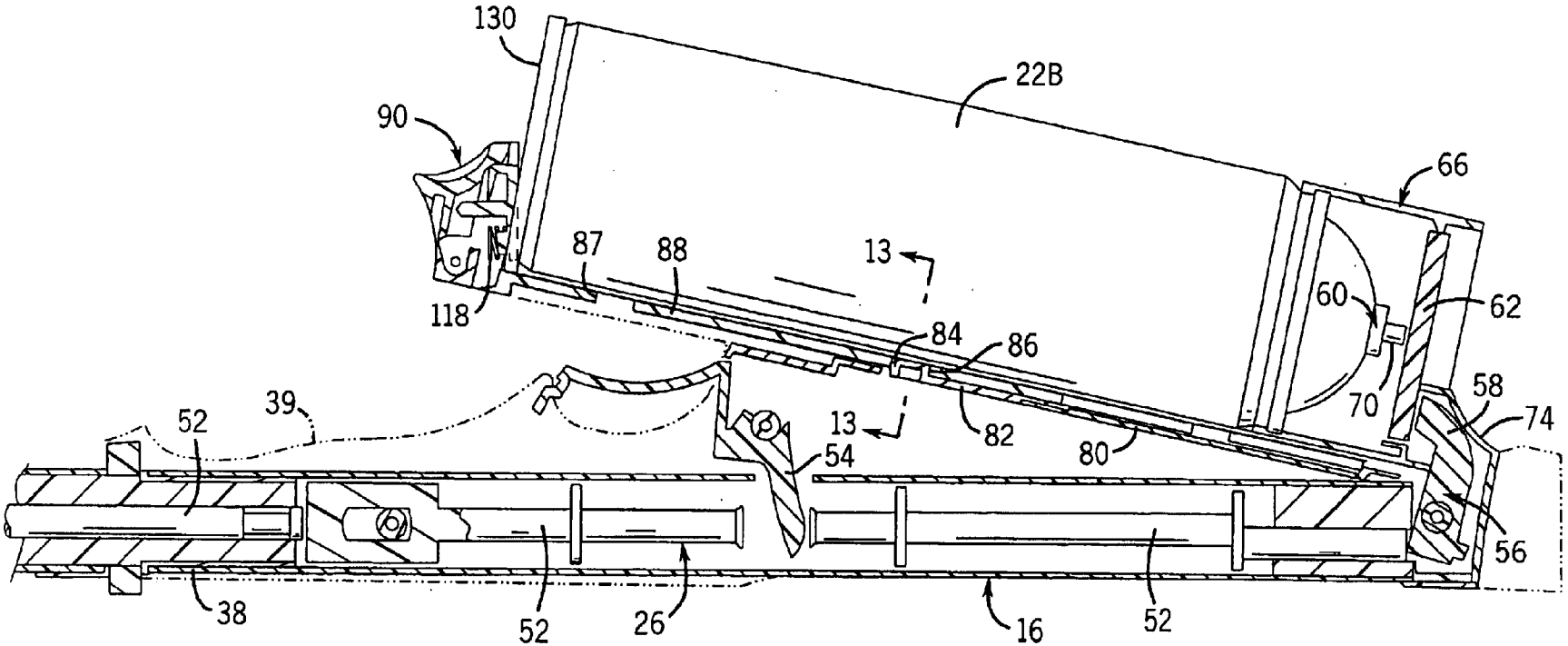
FIG. 7 is a view similar to FIG. 6 albeit taken along line 7—7 of FIG. 5; showing the canister retainer extended to hold a full-size canister.

Referring to FIGS. 4, 9, 10 and 13, The slide 88 forms a track (comprised of parallel channels 92 formed by guides 94) that slidably mates with the rail 80 and retains the heel assembly 90 to the main body 16. Mating stop features (not shown) at the ends of the rail 80 and slide 88 prevent the heel assembly 90 from separating from the main body 16. Depressing the locking tab 82 allows the heel assembly 90 to be slid back and forth along the rail 80. The locking tab 82 will "click" into one of the two receivers 86 and 87 when aligned to fix the position of the heel assembly 90. When the locking tab 82 is engaged with receiver 87 the retainer assembly 20 accepts a full-size canister (as shown in FIGS. 5 and 7) and when engaged with receiver 86 the retainer assembly 20 accepts a compact canister (as shown in FIGS. 4 and 6). The full-size canister can be a conventional 16 oz. aerosol can and the compact canister can be a conventional 8 oz. can. However, the retainer assembly 20 can be made so that the locking tab 82 locks the heel assembly 90 in position to accept canisters of any unconventional size, which may be preferred to assure that proper canisters (containing proper chemicals) are used with the cleaning device 10. It should also be noted that additional receivers could be formed in the slide 88 for additional preset adjustments.

Figures 9, 10, 11, 12:
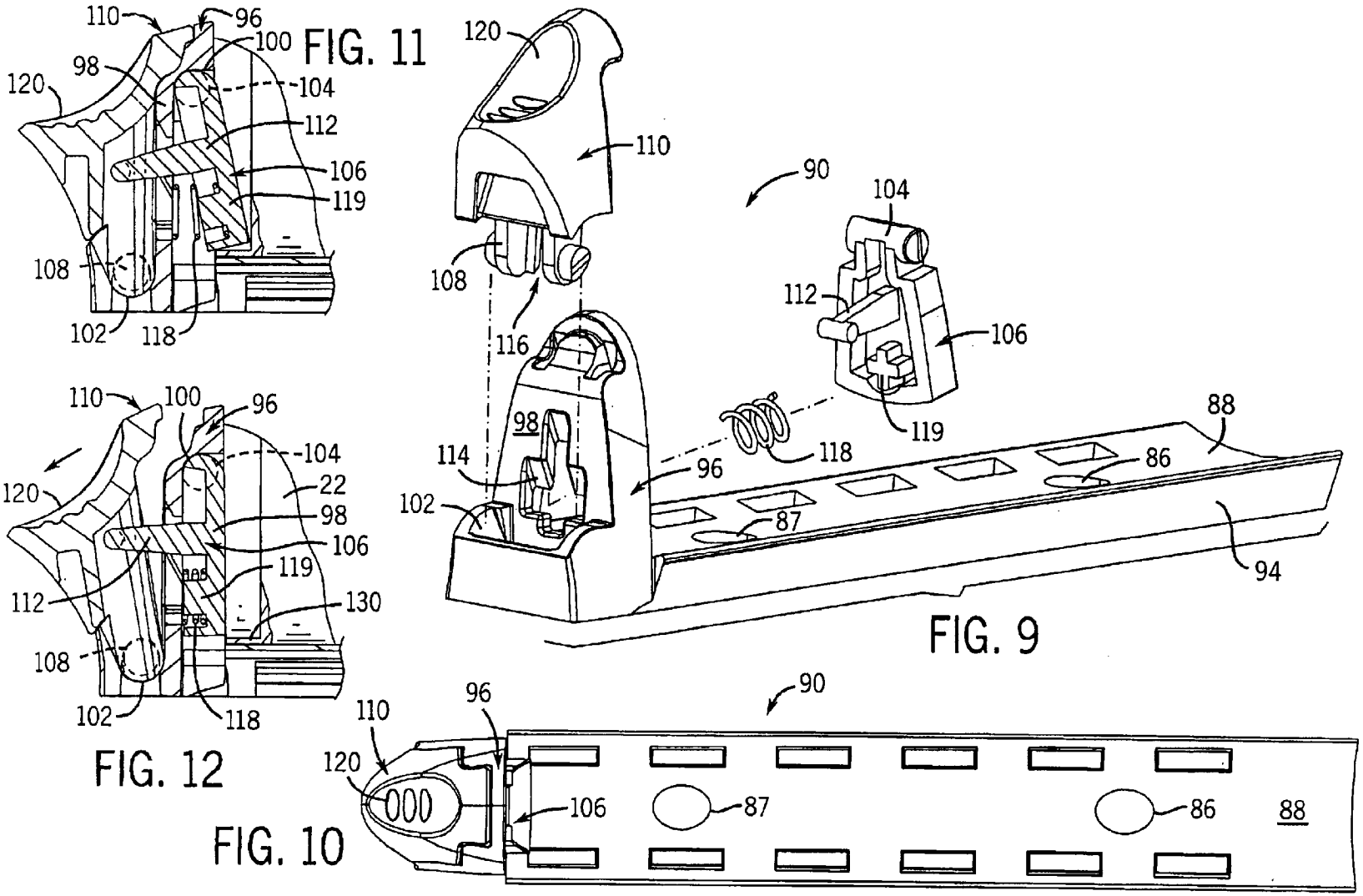
FIG. 9 is an exploded perspective view of a heel assembly of the adjustable canister retainer.
FIG. 10 is a top plan view of the heel assembly.
FIG. 11 is a partial cross-sectional view taken along arc 11—11 of FIG. 7 showing a latch assembly at the heel of the adjustable canister retainer engaging a rim at the bottom of the canister.
FIG. 12 is a view similar to FIG. 11 showing the latch assembly disengaged from the canister.
Figure 13:
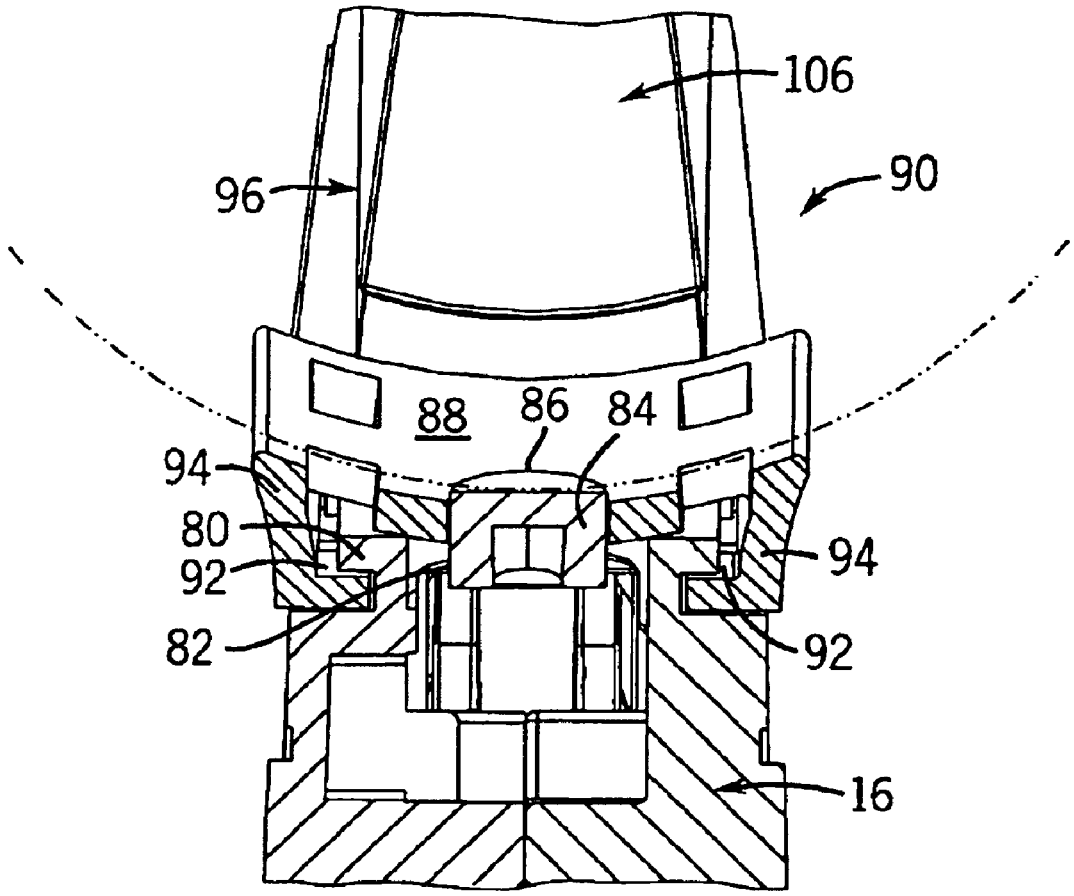
FIG. 13 is a cross-sectal view taken along line 13—13 of FIG. 7.

Referring now to FIGS. 6, 9 and 11–12, the slide 88 of the heel assembly 90 has at its back end a latch mount 96 defining a upright wall 98 at essentially a right angle to the slide track between two pivot grooves 100 and 102. Pivot groove 100 receives a pivot end 104 of a latch 106 and pivot groove 102 receives a pivot end 108 of a thumb-operated release lever 110. The latch 106 has a T-shaped stem 112 that fits through a cross-shaped opening 114 in the wall 98 and into a slot 116 in the release lever 110 to make a bayonet type connection. The free end of the latch 106 is biased by a spring 118 mounted on a boss 119 toward the toe stop 74. The release lever 110 has a ribbed cup area 120 for the operator's thumb. Referring to FIGS. 11–12, depressing the release lever 110 pivots the free end of the release lever 110 away from the wall 98 which pulls the free end of the latch 106 toward the wall 98 and away from the toe stop 74 against the force of the spring 118. This clears the latch 106 from the canister 22 so that it can be removed from the main body 16. Releasing the release lever 110 allows the spring 118 to reset the latch 106. A canister can then be retained by simply sliding the overcap 66 into the retainer assembly 20 until the toe stop 74 fits into the D-shaped recess 72 (as shown in FIG. 6) and then pushing canister 22 against the rail 80 until the latch 106 snaps against a rim 130 in the cupped bottom end of the canister 22.

It may be preferred to use the device with the larger full-size canister for cleaners that are used sparingly and frequently and the compact canisters for those cleaners with more judicious and less frequent use. It may also be advantageous to use a large canister 22B when the cleaning device 10 is being used for low or floor level applications in which little or no lifting of the device is required and then use a small canister when the device is used in the hand-held configuration 22A, as shown in FIG. 2), overhead or otherwise lifted by the user so as to reduce arm strain. Additionally, when the large canister is used, the slide 88 is moved to an extended position in which the heel assembly 90 is positioned almost directly over (or beneath depending on its orientation) the trigger 30 on the main body 16, as shown in FIG. 5. The heel assembly 90 thus tends to block the trigger 30 from being inadvertently depressed (causing unintended spraying) when the device is being operated with the remote trigger 28. Depending on the size of the guides 4 of the slide 88, even when the large canister is used there can be sufficient space to permit it to be depressed when the main body 16 is grasped by its handle 39.

In operation, a user generally utilizes the cleaning device 10 like any conventional poled or hand-held cleaner. With reference to FIGS. 1, 6 and 8, when the user desires to spray cleaner onto the surface being cleaned, the user simply squeezes either trigger 28 or 30, which slides the core pieces 52 to pivot the end 58 of the actuator lever 56 against the lever arm 62 of the overcap 66 which in turn moves the valve stem 70 to open the canister valve 60 and spray out cleaner. When the triggers 28 and 30 are released, springs (not shown) bias the core pieces 52 back to their original, non-activated position. This action relieves the force on the actuator lever 56 and a spring (not shown) in the canister valve 60 returns the valve stem 70 back to its original position, closing the valve and stopping spraying.

Thus, the present invention provides a trigger actuated cleaning device that is convertible between pole and hand-held configurations. It further is adapted to retain an aerosol spray canister of cleaner in either of two sizes such that a smaller can be used when the device is used overhead or otherwise lifted, such as when in the hand-held configuration, to reduce arm strain on the user. The canisters snap into the device and release with the press of a button. A simple sliding adjustment accommodates a different sized canister. A deflectable locking tab stops and secures the sliding components at the desired locations for each canister size.

It should be appreciated that a preferred embodiment of the invention has been described above. However, many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention is a trigger operated cleaning device having an improved adjustable retainer assembly for mounting various sized aerosol spray canisters containing pressurized cleaning agents.

What is claimed is:

1. An adjustable retainer for mounting a canister containing a pressurized cleaning agent to a cleaning device, the retainer comprising:

a toe stop;

a rail fixed with respect to the toe stop; and a heel assembly slidably mounted to the rail and adapted to be releasably held in a fixed position with respect to the rail, the heel assembly including a slide and a latch pivotable relative to the slide, the latch being suitable to abut against the canister so as to releasably lock the canister between the heel assembly and the toe stop.

2. The retainer of claim 1, wherein the latch is biased to engage the canister when the canister is inserted between the toe stop and the heel assembly.

3. The retainer of claim 2, wherein the heel assembly further includes a spring for biasing the latch.

4. An adjustable retainer for mounting a canister containing a pressurized cleaning agent to a cleaning device, the retainer comprising:

a toe stop;

a rail fixed with respect to the toe stop; and a heel assembly slidably mounted to the rail and adapted to be releasably held in a fixed position with respect to the rail, the heel assembly including a latch to releasably lock the canister between the heel assembly and the toe stop;

wherein the latch is biased to engage the canister when the canister is inserted between the toe stop and the heel assembly;

wherein the heel assembly further includes a spring for biasing the latch;

wherein the heel assembly further includes a pivotal release lever.

5. The retainer of claim 4, wherein the release lever engages the latch in a bayonet connection.

6. The retainer of claim 4, wherein the release lever includes a thumb grip.

7. The retainer of claim 4, wherein the heel assembly includes a slide defining a track adapted to mount the heel assembly to the rail.

8. The retainer of claim 7, wherein the slide includes a latch mount at one end defining at least one pivot connection for the latch and the release lever.

9. The retainer of claim 8, wherein the latch mount defines an upstanding wall extending essentially perpendicular to the track disposed between two pivot grooves each receiving a pivot end of one of the latch and release lever.

10. An adjustable retainer for mounting a canister containing a pressurized cleaning agent to a cleaning device, the retainer comprising:

a toe stop;

a rail fixed with respect to the toe stop; and a heel assembly slidably mounted to the rail and adapted to be releasably held in a fixed position with respect to the rail, the heel assembly including a latch to releasably lock the canister between the heel assembly and the toe stop;

wherein the heel assembly includes a slide having a track slidably engaging the rail and retaining the heel assembly to the rail and wherein a lock arrangement releasably fixes the position of the slide in one of two preset positions.

11. The retainer of claim 10, wherein a first slide position spaces the heel assembly from the toe stop to mount a first sized aerosol canister and a second slide position spaces the heel assembly from the toe stop to mount a second sized aerosol canister of a lesser length than the first sized aerosol canister.

12. The retainer of claim 10, wherein the lock arrangement includes a deflectable tab attached to one of the slide and the rail and at least two tab receivers spaced apart along the other of the slide and rail.

13. An adjustable retainer for mounting a canister containing a pressurized cleaning agent to a cleaning device, the retainer comprising:

a toe stop;

a rail fixed with respect to the toe stop; and a heel assembly slidably mounted to the rail and adapted to be releasably held in a fixed position with respect to the rail, the heel assembly including a latch to releasably lock the canister between the heel assembly and the toe stop;

wherein the toe stop is disposed at one end of the rail in contact with one end of the canister and wherein the toe stop includes an alignment feature orienting the canister with respect to a trigger operated actuator member movable to open a valve of the canister for dispensing the cleaning agent therefrom.

* * * * *